US007758445B2

(12) United States Patent
Oldenburg

(10) Patent No.: US 7,758,445 B2
(45) Date of Patent: Jul. 20, 2010

(54) METHOD FOR PRODUCING GOLF SHAFTS OF LIKE FLEX

(75) Inventor: John E Oldenburg, Poway, CA (US)

(73) Assignee: Aldila, Inc., Poway, CA (US)

( * ) Notice: Subject to any disclaimer, the term of this patent is extended or adjusted under 35 U.S.C. 154(b) by 39 days.

(21) Appl. No.: 10/598,115

(22) PCT Filed: Feb. 17, 2005

(86) PCT No.: PCT/US2005/005010

§ 371 (c)(1),
(2), (4) Date: Aug. 17, 2006

(87) PCT Pub. No.: WO2005/079930

PCT Pub. Date: Sep. 1, 2005

(65) Prior Publication Data

US 2007/0184914 A1 Aug. 9, 2007

Related U.S. Application Data

(60) Provisional application No. 60/545,750, filed on Feb. 18, 2004.

(51) Int. Cl.
*A63B 53/10* (2006.01)

(52) U.S. Cl. ..... 473/289; 473/319

(58) Field of Classification Search ..... 473/289, 473/319; 156/188; 264/635; 428/36.3, 36.9
See application file for complete search history.

(56) References Cited

U.S. PATENT DOCUMENTS 2,007,970 A 7/1935 Hartley
3,963,236 A * 6/1976 Mann ..... 473/289
3,998,458 A * 12/1976 Inoue et al. ..... 473/319
4,023,801 A * 5/1977 VanAuken ..... 473/319
4,132,579 A * 1/1979 VanAuken ..... 156/189
4,319,750 A 3/1982 Roy
4,455,022 A * 6/1984 Wright ..... 473/318
5,028,464 A * 7/1991 Shigetoh ..... 428/35.9
5,143,374 A * 9/1992 Shibasaki ..... 473/319
5,156,396 A 10/1992 Akatsuka et al.
5,308,062 A 5/1994 Hogen
5,421,573 A * 6/1995 Kawamatsu ..... 473/319
5,485,948 A 1/1996 McCrink
5,620,380 A 4/1997 Tennent et al.

(Continued)

FOREIGN PATENT DOCUMENTS

JP 8-289947 2/1996

*Primary Examiner*—Stephen L. Blau
(74) *Attorney, Agent, or Firm*—Birch, Stewart, Kolasch & Birch, LLP

(57) ABSTRACT

The method of producing tubular golf club shafts (10) of the same longitudinal stiffness and varying weights by wrapping composite materials on a tapered mandrel (15), or mandrels, having a given taper profile, producing a core (30) of angle-fiber-and-resin material and a shell (31) of longitudinal-fiber-and-resin material, and varying the weight of the cores to vary the shaft weight while maintaining the core size and the shell size the same. This is accomplished by moving the core along a taper profile to compensate for the change in the amount of material, thus maintaining the longitudinal stiffness/bending profile the same in the shafts of greatly varying weight. A representative family of shafts (10) has nominal weights of 55, 65, 75, 85, 95 and 105 grams, with the same stiffness/bending profile.

4 Claims, 2 Drawing Sheets

U.S. PATENT DOCUMENTS

| | | | |
|---|---|---|---|
| 5,626,529 | A | 5/1997 | Roy |
| 5,634,861 | A | 6/1997 | Yamamoto et al. |
| 5,904,628 | A | 5/1999 | MacKay, Jr. et al. |
| 6,273,830 | B1 | 8/2001 | Takemura et al. |
| 6,354,957 | B1 | 3/2002 | Saito et al. |
| 6,652,389 | B2 | 11/2003 | Hisamatsu et al. |
| 2002/0187850 | A1 | 12/2002 | Kluck et al. |
| 2004/0092330 | A1 | 5/2004 | Meyer et al. |
| 2006/0128494 | A1 | 6/2006 | Kumamoto |

* cited by examiner

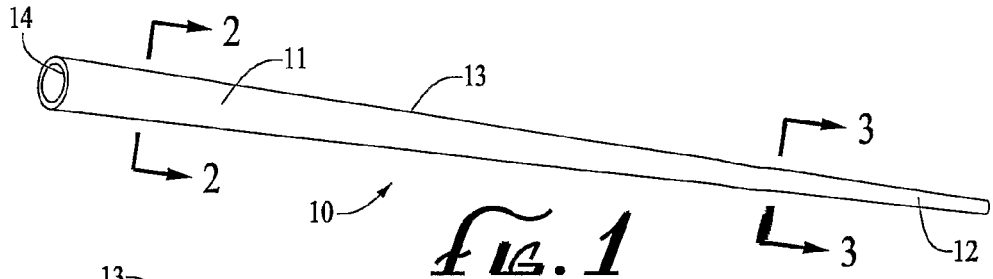
FIG. 1
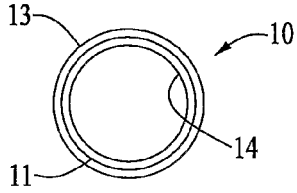
FIG. 2
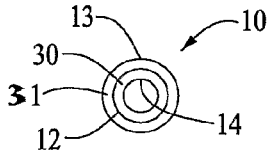
FIG. 3
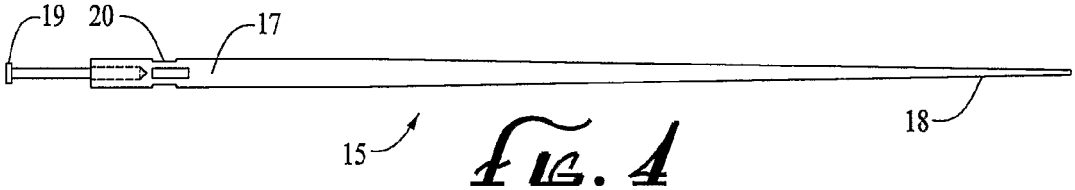
FIG. 4
FIG. 5
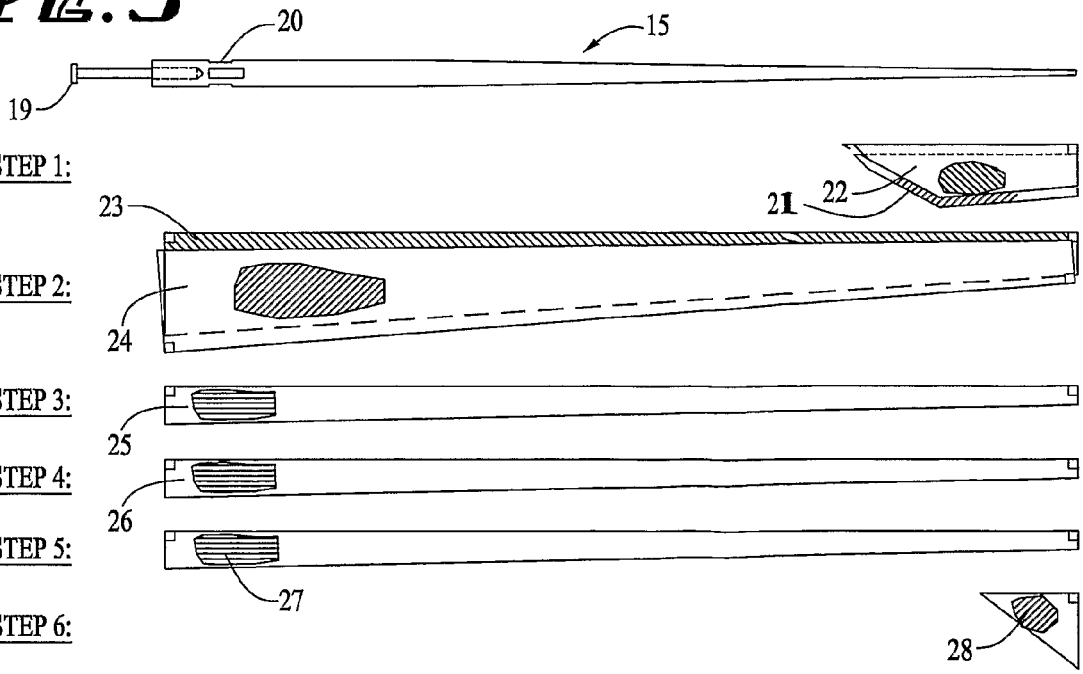

METHOD FOR PRODUCING GOLF SHAFTS OF LIKE FLEX

CROSS-REFERENCE TO RELATED APPLICATION

This specification claims priority from co-pending provisional U.S. application Ser. No, 60/545,750, filed Feb. 18, 2004 entitled "Method for producing golf shafts of like flex".

BACKGROUND

It is well known to those skilled in the art of producing composite golf club shafts that such shafts are formed by wrapping or rolling sheets of fiber materials impregnated with resin, typically epoxy, around elongated tapered tools, called "mandrels", which are sized and shaped to form the materials into elongated, tapered tubes comprising selected numbers of layers of the composite materials. Each mandrel has a taper profile from a larger butt-end portion to a smaller tip-end portion and the cross-sectional size and shape that is desired for the inside surface of the shaft, and the number of wraps determines the wall thickness along the taper after the shaft is rolled, cured and finished in a well known manner. Typically, the outside surface of each shaft is finished to a smooth surface, and the shaft is trimmed to a pre-selected standard length, and painted before the club head and grip are assembled to produce a finished golf club.

Also well known is the fact that the amounts and types of fiber materials used in a shaft will determine two of the most important properties of the shaft, weight and longitudinal flex or bending, referred to as overall stiffness. Basically, the weight is determined by the total amount of material in the finished shaft, and the longitudinal stiffness depends primarily upon the amount of longitudinally extending fibers in a shaft. These are called "zero" ply materials or fibers because they are at substantially a zero angle with the longitudinal axis of the shaft, as opposed to so-called "angle" ply or "bias" ply materials on which the fibers are dispersed at substantially forty-give degree angles with the axis of the height. These contribute to the overall weight of the shaft and impart primarily torsional stiffness to the shaft.

Golf club shaft designers are able to produce shafts with different weights, stiffness and flex characteristics to suit the preferences of different golfers and for different clubs. For example, lighter shafts may be preferred for higher club speed, and stiffer shafts may be preferred for greater head control with a wide range of variations for adapting clubs to the tastes of a wide variety of golfers and situations. The general objective of this invention is to provide a novel method for producing golf club shafts of like flex profiles and selectively different weights, and provide a family of such shafts.

SUMMARY OF THE INVENTION

The invention resides in a novel method of producing a family of golf club shafts having the same longitudinal bending profiles and greatly varying weights to meet the needs and desires of different golfers for different weights of golf clubs without changing the longitudinal stiffness of the shaft. This is accomplished by fixing the amount, location and types of materials that govern longitudinal bending in an outside shell of the shaft, varying the amount and type and thus weight of the material that is used to control the torsional stiffness of the shaft in an inside core of the shaft, and shifting the shaft along the taper profile of the mandrel a selected distance, that is sufficient to compensate for the change in the size of the core that would be produced by the change in the amount of the core material, to maintain the prescribed outside diameter of the shaft.

More specifically, in the preferred mode and embodiment of the invention, a single mandrel longer than the length of the shafts to be produced is used to produce a first shaft by wrapping a predetermined first amount of composite angle ply material in a first position on the mandrel to form a core of the angel ply material, and wrapping a predetermined second amount of composite zero ply material around the mandrel and the core thereon to form the shell of the first shaft, and producing at least a second shaft on the mandrel by wrapping a predetermined second amount of composite angle ply material in a second position on the mandrel to form a core for the second shaft that differs in weight from the core of the first shaft by a predetermined increment, and wrapping substantially the same predetermined second amount of composite zero ply material on the mandrel around the second core, the second position on the mandrel being spaced along the taper profile in a direction and by a distance that is calculated to make the outside of the core substantially the same size in the second shaft as in the first shaft. For convenience, the first shaft is the heaviest of the family and is produced beginning at a preselected distance from the tip end of the mandrel, and progressively lighter members of the family are produced on progressively larger portions of the mandrel, farther up the taper profile using this method, a representative family of shafts of a given stiffness/bending profile may be produced with incremental differences in weight by different weights of core material and with having inside surfaces that are formed on different portions of the taper profile to compensate for the differences in the core size resulting from the differences in the amounts of core material. It will be apparent that this can be achieved by moving the shaft along the taper profile of one mandrel, or instead by providing different mandrels constituting different portions of the same taper profile.

Other aspects and advantages of the invention will become apparent from the following detailed description, taken in conjunction with the accompanying drawings.

BRIEF DESCRIPTION OF THE DRAWINGS

FIG. 1 is a perspective view of a representative golf club shaft, with length contracted and taper exaggerated for clarity of illustration;

FIG. 2 is an enlarged cross-sectional view taken along line 2-2 of FIG. 1;

FIG. 3 is an enlarged cross-sectional view taken along line 3-3 of FIG. 1;

FIG. 4 is a side-elevational view of a representative mandrel, with length similarly contracted and taper exaggerated for clarity of illustration, and operational elements shown schematically;

FIG. 5 is a schematic view showing the representative mandrel position relative to six Steps of a representative mode of the method of the invention, for producing one shaft of the family of shafts, with each Step showing schematically the shape, position and type of composite material to be wrapped around the mandrel in that Step;

DETAILED DESCRIPTION OF THE PREFERRED MODE OF EMBODIMENT

Figure 6:
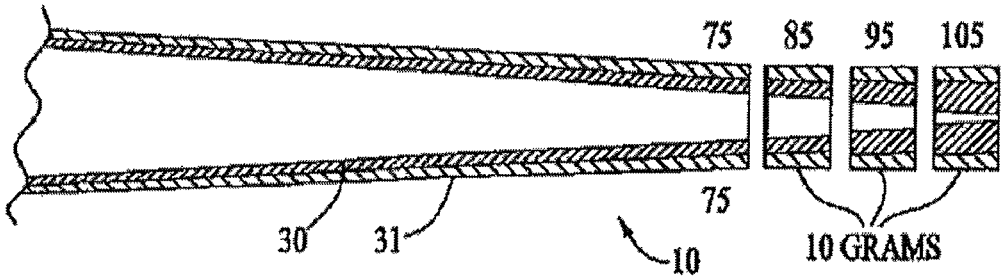
FIG. 6 is a schematic representation of a portion of a shaft, with incremental tip sections illustrating the differences in amounts of materials and weights, in different shafts of a representative family of shafts.

Shown in the drawings for purposes of illustration is a representative composite golf club shaft, indicated generally by the reference number 10, comprising an elongated tubular body having a butt-end portion 11 on which a grip (not shown) will be mounted and a tip-end portion 12 on which a golf club head (not shown) will be mounted in the completed golf club. The outside surface 13 of the shaft is tapered from a maximum outside diameter ("O.D.") in the butt-end portion, typically in the range of about 0.600 to 0.625 of an inch, and the inside surface 14 is similarly tapered, along a preselected taper profile designed for a particular taper profile designed for a particular shaft. The tip-end portion of the shaft typically has an outside diameter of approximately 0.335 to 0.400 of an inch to fit into a golf club head. The usual length of the shaft is on the order of forty-six or forty-seven inches.

Such shafts typically are mass-produced by wrapping or rolling sheets of composite fiber-and-resin materials, under pressure, around elongated tapered tools called "mandrels" having outside taper profiles that correspond to the desired tapers of the shafts to be produced and having a length greater than the overall length of the shaft to be produced. A representative mandrel 15 is shown in FIG. 4, it being understood that both the shaft 10 and the mandrel 15 are shown with a foreshortened length and exaggerated taper for clarify of illustration. The representative mandrel is an elongated metal rod with a carefully shaped outside surface of circular cross-section that is tapered from a butt-end portion 17 having an O.D. on the order of 0.560 to 0.575 of an inch and a tip-end portion 18 having an O.D. as small as the range of 0.025 to 0.10 all depending upon the desired size and wall thickness of the finished shaft, which are matters of choice and design of the shaft designer. The overall length of the mandrel is several inches longer than the length of the shafts to be produced on the mandrel, and includes operating elements illustrated schematically at 19 and 20 in FIG. 4. The taper rate in the representative mandrel 15 is substantially constant although changes in the rate my be provided at selected locations to modify the flex profile of a particular shaft or to accommodate the thickness of reinforcing inserts of composite material sometimes provided as reinforcements, all according to techniques that are well known in the art.

Shown in FIG. 5 is an illustrative series of Steps of the kind used in the present invention to produce shafts 10 on a mandrel 15 which is shown schematically in a fixed longitudinal portion above several sheets of composite materials that are to be wrapped on the mandrel. It will be seen in FIG. 5 that six representative Steps are shown in the series and eight representative sheets of materials, including two short trapezoidal sheets 21 and 22 at the tip end of the shaft to be wrapped in Step 1; two elongated trapezoidal sheets 23 and 24 of opposite angled plies to be wrapped together in Step 2; three elongated trapezoidal sheets 25, 26 and 27 to be wrapped in Steps 3, 4 and 5; and one short triangular sheet to be wrapped around the tip portion in Step 6. Each representative sheet is shown as having a straight edge (the upper edges in FIG. 5) to be fixed on the mandrel at the beginning of the wrap, and angled opposite sides for spiraling around the mandrel during the wrap, the ends of the shaft being formed by end edges of the strips that are perpendicular to the longitudinal axis of the mandrel. The width of each sheet is sufficient to make a preselected number of layers around the mandrel 15, and the composition of each sheet is carefully selected to provide the types and weights of composite material that will produce the desired shaft 15.

It can be seen in FIG. 5 that angle-ply materials are applied in Steps 1 and 2 of the representative process to form a torsionally stiff inner core and (indicated generally at 30 in FIGS. 2 and 3) reinforced end portions of the shaft and zero-ply materials are applied in Steps 3, 4 and 5 to form a longitudinally stiff outer shell indicated at 31 around the core 30. The specific amounts and types of materials are selected by the designer to produce the desired weight and bending profile of a particular shaft. Of course, the total amount of all materials in the shaft determines the weight of the shaft, while the zero-ply materials are primarily determinative of longitudinal stiffness, these being two of the most important characteristics in shaft design. Shaft designers have many approaches to the production of the most effective and desirable shafts, varying the amounts, types and placement of materials in efforts to achieve optimum results.

In accordance with the present invention, a family of golf club shafts is provided with greatly varying weights and having substantially the same longitudinal stiffness/bending profile by using the same amount and types of zero-ply materials in each shaft of the family, varying the amounts and weights of the angle-ply materials by a selected amount in each shaft to provide an incremental step from shaft to shaft in the family, and shifting the shaft along the taper profile by an amount and in a direction that will compensate for the change in O.D. of the core 30 produced by the difference in the amount of angle-ply material used in the core, thereby maintaining the inside diameter ("I.D.") and, consequently the O.D., of the shell 3, to maintain its stiffness. This can be accomplished conveniently on the same mandrel 15 by moving the wrap a calculated distance along the taper profile (toward the larger end when the amount of core material has been decreased), or can be done on a different mandrel having the same taper profile.

While any desired increments of change of shaft weight may be produced with the present invention, a presently preferred family of shafts for the present invention uses substantially uniform increments of change of ten grams per shaft from a high end of 105 grams to a low end of 55 grams, it being understood that the range is discretionary with the shaft manufacturer and that the weight designations are nominal, and could go even lower and higher. The weights actually will vary within tolerances, typically as much as ± five grams or more, which can be affected by finish sanding, painting and other variations in the process in the finished shaft.

To illustrate the process, it can be assumed that the shaft 10 shown in the drawings and FIG. 5 is a "75 gram" shaft, and that the tip edges of the materials are positioned on the mandrel 15 a distance "$\chi$" from the end of the taper profile. To produce a "65 gram" shaft 10, ten grams of weight will be removed from the angle-ply materials in Step 2 of FIG. 5 and the wrap will be moved up the taper profile, to the left in FIG. 5, by a distance "$\gamma$" sufficient to adjust the O.D. of the lighter core to be substantially the same as the O.D. of the heavier core 30. For example, depending upon the specific taper profile, "$\chi$" may be calculated to be in the range of 2.0 to 3.0 inches, and "$\gamma$" may be in the range of 4.0 to 5.0 inches. Then the process is repeated with the other steps remaining the same. It is to be understood that, for heavier or lighter shafts in the family, the taper profile may be extended onto a different mandrel (not shown). It also is to be understood that the number of wraps of materials illustrated will be widely variable according to the types of materials selected and used, some fibers being heavier and larger to form thicker layers in the shaft, and some being finer and smaller so that substantially more layers are used. Heavier materials may be limited to ten or fewer layers, while finer materials may have as many as fifteen, twenty or more layers.

As has been indicated, the fiber type, location and amounts contained in the zero-ply shell 31 govern the overall flex and bending profile of a shaft. The localized bending stiffness is EI, where "E" is the material modulus and "I" is the mass moment of inertia about the longitudinal ("3") axis of the shaft at a particular cross section, determined by the equation:

$$I = \frac{\pi(D^4 - d^4)}{64}$$

where "D" is the O.D. of the section and "d" is the I.D. Thus, to reduce the weight of a shaft while maintaining the same flex/stiffness profile, a predetermined weight material is removed from the core 30, or "torque core", composed of angle-ply fibers, to reduce the overall weight. If this reduced amount of material is wrapped around the same portion of the taper profile on the mandrel, the mass moment of inertia and longitudinal stiffness would decrease in the shell 31 because of the reduced diameters, but this is counteracted in the invention by building the lighter shaft higher on the taper profile, to increase the diameter sufficiently to return the moment of inertia, and stiffness, to that of the heavier shaft by sliding the wrap or "build" higher up the mandrel, the shaft will be formed with a thinner wall with larger diameters, and the overall weight will be reduced.

FIG. 6 shows an exaggerated taper of a representative shaft with incremental reductions (or additions) of materials indicated schematically by showing the tip of the shaft moving up the taper profile of a mandrel for some of the different weights in a representative family of shafts the shaft length remains the same, on the order of forty-six inches, because the butt-end of the shaft moves up the taper profile by the same increments as the tip increments illustrated.

It should be noted that the representative finish wrap 28 on the tip will be moved up the profile to protect the tip end of the shell 31 from damage in the final grinding of the tip to the desired O.D. for mounting of a club head. The increase in the O.D. of the tip wrap in larger diameter (lighter) shafts will result in more material removal during grinding to the desired O.D., with resulting further reduction in total weight. It also will be understood that lighter shafts will have correspondingly reduced torsional stiffness.

Figure 7:
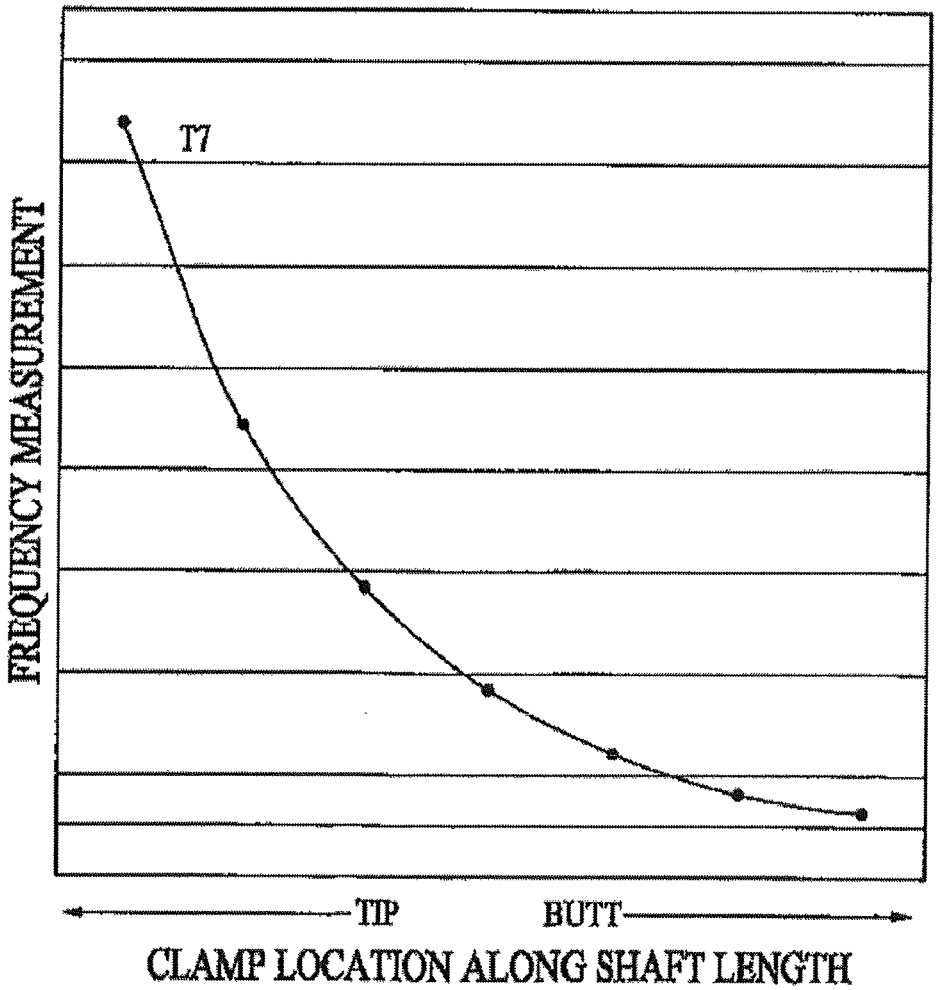
FIG. 7 is a diagram of a stiffness profile that can be maintained in the different weights of the shafts in the family of shafts.

Shown in FIG. 7 is a representative "Stiffness Profile" that shows the stiffness characteristics that may be achieved, and substantially uniformly maintained in a preferred family of shafts according to the present invention. Such a profile is measured by oscillating the shafts with various beam lengths and counting the number of cycles that occur over a specified period of time, referred to as the shafts frequency. Flex also can be measured through dynamic loading, or under static conditions in a laboratory. Different stiffness or flex families can be provided typically being designated as "L", "A", "R", "S" and "X", with "X" being the stiffest.

From the foregoing, it will be evident that the present invention provides a method for producing a family of shafts having essentially the same longitudinal bending stiffness and greatly varying weights, and provides the novel family of shafts as well. It also will be evident that, while a preferred mode and embodiment of the invention have been described in detail, various modifications and changes may be made by those skilled in the art without departing from the invention.

I claim as my invention:

1. A family of tubular golf club shafts having substantially the same longitudinal bending stiffness profiles and incremental differences in weights, each of said shafts comprising:

a shell of composite longitudinal-fiber-and-resin material having a preselected amount of longitudinal-fiber-and-resin material that produces said substantially same longitudinal bending/stiffness profile in each shaft of the family; and a core of composite angle-fiber-and-resin material that produces torsional stiffness in said shaft and having a preselected weight of the angle-fiber-and-resin, the preselected weight of angle-fiber-and-resin material in each shaft of said family being different from the preselected weights in the other shafts of the family to establish the incremental differences in the weights of the shafts, the core of each shaft having an outside surface that is maintained substantially the same size to maintain the same size shell in each shaft, wherein said shafts are of a same predetermined length.

2. The family of golf club shafts as defined in claim 1, wherein said shafts have inside surfaces that taper along a selected taper profile longer than said predetermined length from a larger butt-end portion of the taper profile to a smaller tip-end portion of the taper profile.

3. The family of golf club shafts as defined in claim 1, wherein the incremental differences in weights are substantially the same from the heaviest of said shafts to the lightest.

4. The family of golf club shafts as defined in claim 3, wherein the family comprises six shafts ranging in nominal weight from a lightest shaft approximately fifty-five grams to a heaviest shaft of approximately one hundred and five grams, each increment being approximately ten grams.

* * * * *